US008974039B2

(12) United States Patent
Takagi et al.

(10) Patent No.: US 8,974,039 B2
(45) Date of Patent: Mar. 10, 2015

(54) LIQUID SUPPLYING UNIT PROVIDED WITH CIRCUIT SUBSTRATE

(71) Applicants: Yuki Takagi, Nagoya (JP); Hirotake Nakamura, Nagoya (JP)

(72) Inventors: Yuki Takagi, Nagoya (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/725,461

(22) Filed: Dec. 21, 2012

(65) Prior Publication Data

US 2013/0162721 A1 Jun. 27, 2013

(30) Foreign Application Priority Data

Dec. 22, 2011 (JP) ..... 2011-280908

(51) Int. Cl.
*B41J 2/14* (2006.01)
*B41J 2/16* (2006.01)
*B41J 2/175* (2006.01)

(52) U.S. Cl.
CPC ..... *B41J 2/14072* (2013.01)
USPC ..... 347/50; 347/86

(58) Field of Classification Search
CPC ..... B41J 2/14072; B41J 2/3352
See application file for complete search history.

(56) References Cited

U.S. PATENT DOCUMENTS

| | | | | |
|---|---|---|---|---|
| 6,502,917 | B1 * | 1/2003 | Shinada et al. | 347/19 |
| 7,484,825 | B2 * | 2/2009 | Asauchi | 347/19 |
| 7,837,312 | B2 * | 11/2010 | Wanibe | 347/86 |
| 7,914,135 | B2 * | 3/2011 | Wanibe | 347/86 |
| 2006/0139393 | A1 | 6/2006 | Zhang et al. | |
| 2006/0219726 | A1 | 10/2006 | Yajima et al. | |
| 2006/0250426 | A1 | 11/2006 | Wanibe et al. | |
| 2006/0250446 | A1 | 11/2006 | Wanibe et al. | |
| 2006/0251430 | A1 | 11/2006 | Wanibe et al. | |
| 2008/0170110 | A1 * | 7/2008 | Chan | 347/86 |
| 2008/0252669 | A1 * | 10/2008 | Aoki et al. | 347/6 |
| 2009/0009561 | A1 | 1/2009 | Yajima et al. | |
| 2010/0091070 | A1 * | 4/2010 | Kimura | 347/50 |

FOREIGN PATENT DOCUMENTS

JP 2007-160588 A 6/2007

* cited by examiner

*Primary Examiner* — Stephen Meier
*Assistant Examiner* — Renee I Wilson
(74) *Attorney, Agent, or Firm* — Baker Botts L.L.P.

(57) ABSTRACT

A circuit substrate includes: a substrate body and an electrode. The substrate body has four sides including first and second sides extending in a first direction and opposing each other in a second direction. The substrate body has a top surface on which the electrode is mounted. The electrode has first and second outer points positioned closest to the first and second sides in the second direction respectively. The top surface has: a first area between the first side and a first imaginary line extending in the first direction and passing through the first outer point; a second area between the second side and a second imaginary line extending in the first direction and passing through the second outer point; and a third area interposed between the first area and the second area in the second direction, the substrate body being formed with a first opening in the first area.

28 Claims, 5 Drawing Sheets

LIQUID SUPPLYING UNIT PROVIDED WITH CIRCUIT SUBSTRATE

CROSS REFERENCE TO RELATED APPLICATION

This application claims priority from Japanese Patent Application No. 2011-280908 filed Dec. 22, 2011. The entire content of the priority application is incorporated herein by reference.

TECHNICAL FIELD

The present invention relates to a liquid supplying unit mountable in a recording device, and a circuit substrate fixed to the liquid supplying unit.

BACKGROUND

There is known in the art an ink cartridge that can be detachably mounted in a mounting unit of a recording device for supplying ink to a recording head of the recording device. Attached to the ink cartridge is a circuit substrate having storing means for storing data indicating information on the ink cartridge, such as quantity of ink remaining in the cartridge, color of ink accommodated in the cartridge, and the like. When the ink cartridge is mounted in the recording device, electrodes provided on the circuit substrate form an electrical connection with device-side terminals provided in the recording device. This electrical contact between electrodes and device-side terminals allows the recording device to access the storing means of the circuit substrate.

In this type of ink cartridge, positioning of the circuit substrate on the ink cartridge is performed by inserting a plurality of protrusions provided on the cartridge through a plurality of holes formed in the circuit substrate. The circuit substrate is fixed to the cartridge by thermally caulking the protrusions.

One conventional technology for fixing the circuit substrate to the cartridge involves thermally caulking of the protrusions inserted through the holes of the substrate at positions before and after electrodes on the substrate with respect to a direction in which the ink cartridge is inserted into the recording device.

SUMMARY

However, when using the fixing method described above, since the device-side terminals lie in a path of the caulk heads as the cartridge is mounted in the recording device, the device-side terminals need to slide over the caulk heads and therefore inevitably contact the same. This contact by the caulk heads can potentially damage the device-side terminals, and such damage may prevent the device-side terminals from coming into contact with the electrodes. Forming caulk heads of a size or shape designed to avoid contact with the device-side terminals would make the caulking process more expensive.

In view of the foregoing, it is an object of the present invention to provide a circuit substrate, an ink cartridge provided with the circuit substrate, and an inkjet printer whose device-side terminals slide over the circuit substrate when the cartridge is inserted into the printer, which can ensure, with a simple structure, reliable contact between the device-side terminals and electrodes on the circuit substrate without increasing the size of the circuit substrate.

In order to attain the above and other objects, there is provided a circuit substrate including a substrate body and an electrode. The substrate body has a rectangular shape configured of four sides, the four sides including a first side and a second side extending in a first direction and opposing each other in a second direction. The substrate body has a top surface on which the electrode is mounted. The electrode has a first outer point positioned closest to the first side in the second direction and a second outer point positioned closest to the second side in the second direction, a first imaginary line being defined as a line extending in the first direction and passing through the first outer point, and a second imaginary line being defined as a line extending in the first direction and passing through the second outer point. The top surface of the substrate body has: a first area defined between the first side and the first imaginary line; a second area defined between the second side and the second imaginary line; and a third area interposed between the first area and the second area in the second direction, the substrate body being formed with a first opening in the first area.

According to another aspect of the present invention, there is provided a liquid supplying unit including a casing, a liquid outlet portion and a circuit substrate. The casing defines therein a storage chamber configured to store liquid, the casing having a first casing surface and a second casing surface perpendicular to each other. The liquid outlet portion is provided at the first casing surface and configured to supply the liquid in the storage chamber to outside. The circuit substrate is fixed to the second casing surface, and includes a substrate body and an electrode. The substrate body has a rectangular shape configured of four sides, the four sides including a first side and a second side extending in a first direction and opposing each other in a second direction. The substrate body has a top surface on which the electrode is mounted. The electrode has a first outer point positioned closest to the first side in the second direction and a second outer point positioned closest to the second side in the second direction, a first imaginary line being defined as a line extending in the first direction and passing through the first outer point, and a second imaginary line being defined as a line extending in the first direction and passing through the second outer point. The top surface of the substrate body has: a first area defined between the first side and the first imaginary line; a second area defined between the second side and the second imaginary line; and a third area interposed between the first area and the second area in the second direction, the substrate body being formed with a first opening in the first area.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
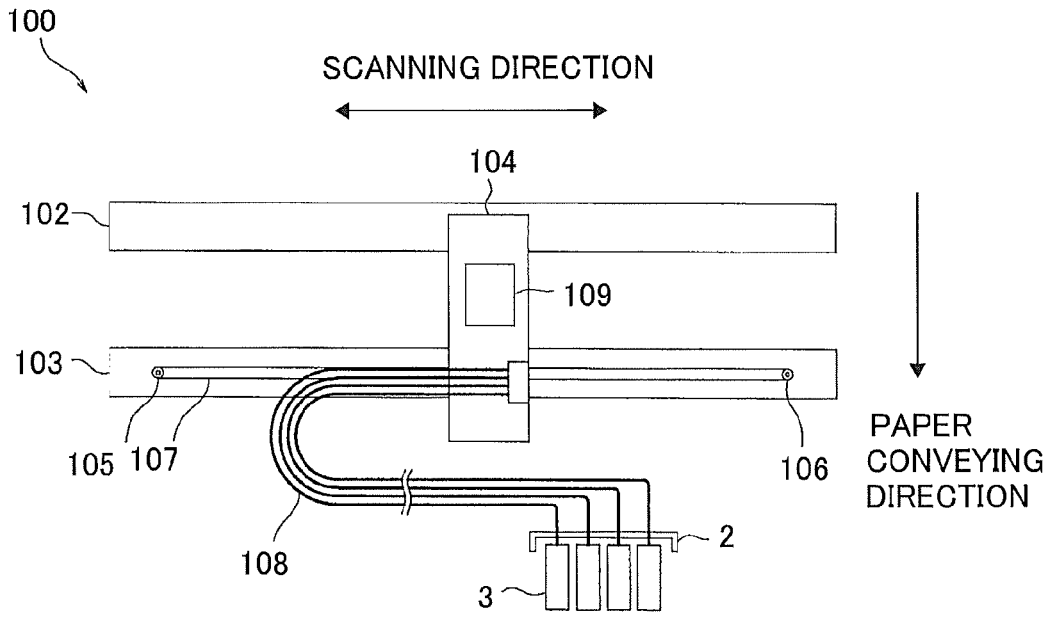
FIG. 1 is a schematic view of relevant parts of a printer having a cartridge mounting unit in which a cartridge according to an embodiment of the present invention is mountable.
Figure 2:
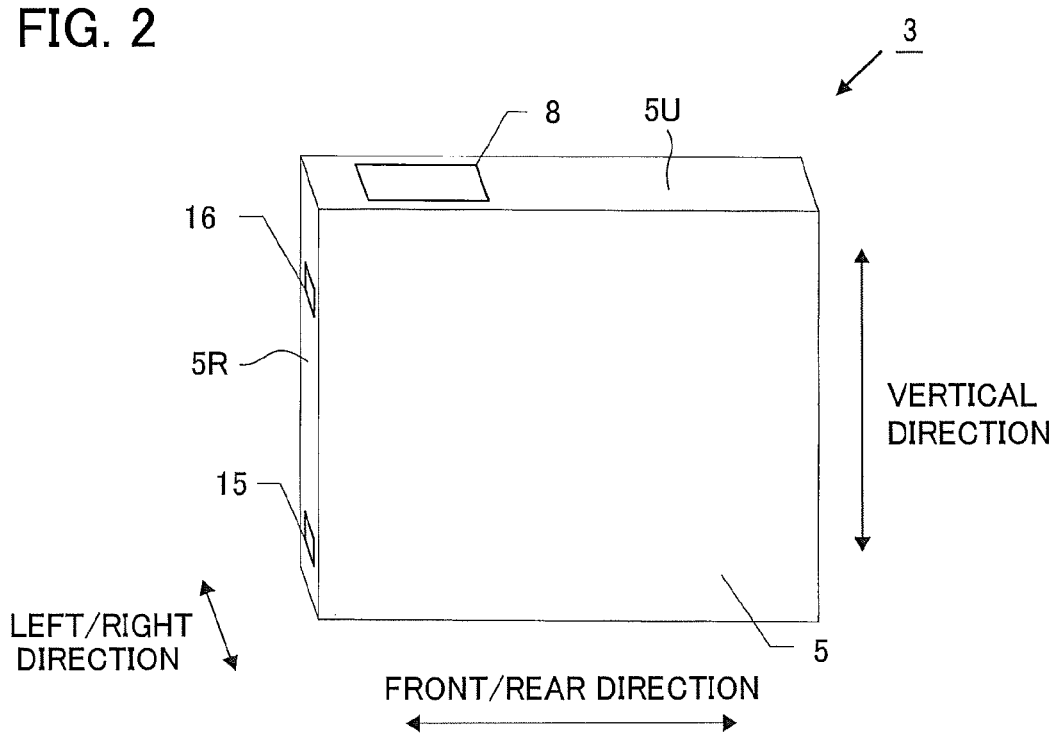
FIG. 2 is a simplified perspective view of the cartridge according to the embodiment.

A circuit substrate 8 and a cartridge 3 according to an embodiment of the present invention will be described while referring to FIGS. 1 through 7.

A printing device 100 is an inkjet printer that has a cartridge mounting unit 2 in which the cartridges 3 are detachably mounted to perform image forming operations.

In the embodiment, the present invention is applied to an inkjet printing device, but the present invention may also be applicable to a liquid extracting unit provided in other type of device that requires liquid in a cartridge to be extracted therefrom when the cartridge is connected to the liquid extracting unit.

As shown in FIG. 1, the printing device 100 includes: a pair of guide rails 102 and 103 extending approximately parallel to each other; an ink ejecting unit 104 supported on the guide rails 102 and 103 so as to be capable of sliding along the same in a longitudinal direction thereof (referred to as a "scanning direction"); a pair of pulleys 105 and 106 disposed one near each of the left and right ends of the guide rail 103; and a timing belt 107 looped around the pulleys 105 and 106. The ink ejecting unit 104 is connected to the timing belt 107. A motor (not shown) is provided in the printing device 100 for driving the pulley 106 to rotate in forward and reverse directions. By rotating the pulley 106 in forward and reverse directions, the timing belt 107 can be reciprocated in the scanning direction. As the timing belt 107 is reciprocated, the ink ejecting unit 104 is also reciprocated in the scanning direction along the guide rails 102 and 103.

An ink ejection head 109 is mounted on a bottom portion of the ink ejecting unit 104. The ink ejection head 109 ejects ink (a liquid) downward toward a recording medium, such as a sheet of paper being conveyed beneath the ink ejection head 109 in a direction orthogonal to the scanning direction (labeled as "paper-conveying direction" in FIG. 1) in order to form images on the recording medium.

The printing device 100 also includes the cartridge mounting unit 2. Four ink cartridges (hereinafter abbreviated as "cartridges") 3 can be detachably mounted in the cartridge mounting unit 2 so as to be replaceable. A plurality of (four in the present embodiment) ink extraction units 14 are provided at a back side of the cartridge mounting unit 2, with one provided for each cartridge 3. Four flexible ink delivery tubes 108 are connected to the ink extraction units 14 respectively for supplying ink in four colors (black, cyan, magenta, and yellow, for example) respectively stored in the cartridges 3 to the ink ejecting unit 104.

Hereinafter, directions in which the cartridges 3 are inserted into and removed from the cartridge mounting unit 2 in the embodiment are defined as rearward and frontward directions, respectively. Specifically, the direction in which the cartridge 3 is pulled out of the cartridge mounting unit 2 is defined as the frontward direction relative to the cartridge mounting unit 2, and the direction in which the cartridge 3 is mounted is defined as the rearward direction. Further, the direction of gravitational force orthogonal to the frontward and rearward directions is defined as downward (or vertical) direction, and the directions orthogonal to the frontward and rearward directions and the vertical direction are defined as left and right directions.

Figure 3:
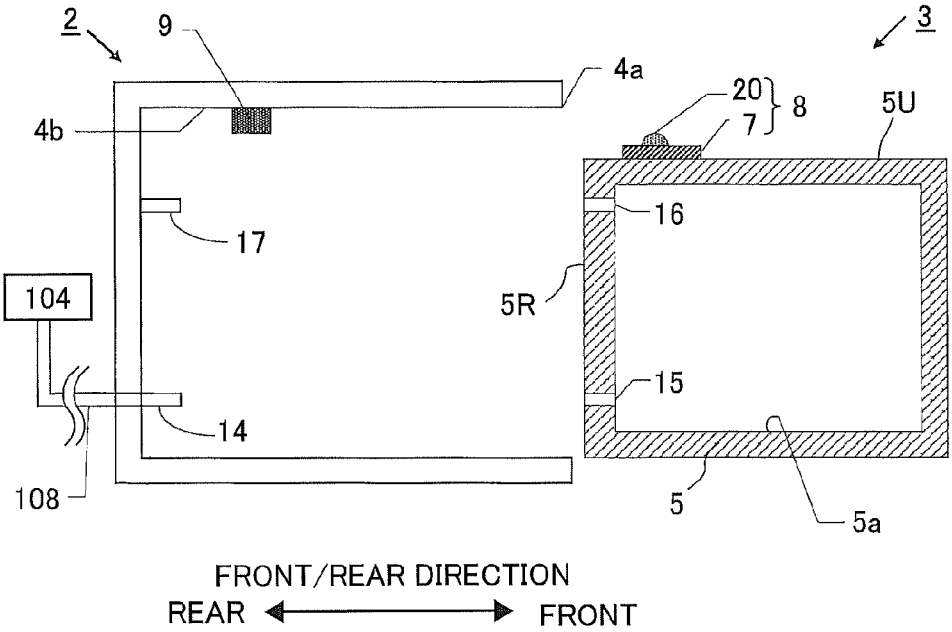
FIG. 3 is a cross-sectional schematic view of the cartridge and the cartridge mounting unit when the cartridge is detached from the cartridge mounting unit.

As shown in FIG. 3, the cartridge mounting unit 2 has a generally rectangular parallelepiped shape with a hollow interior for mounting each of the cartridges 3. As shown in FIG. 3, an opening 4*a* is formed in a front side of the cartridge mounting unit 2, while the interior of the cartridge mounting unit 2 constitutes a mounting space 4*b*. The four cartridges 3 are mounted in the mounting space 4*b* of the cartridge mounting unit 2 through the opening 4*a*.

The cartridge mounting unit 2 includes the ink extraction units 14, a plurality of air exhaustion units 17, and a plurality of connectors 9.

The ink extraction units 14 are provided at the back side (rear side) of the cartridge mounting unit 2 on the opposite side of the mounting space 4*b* from the opening 4*a*. Each ink extraction unit 14 extends in the front-rear direction.

The plurality of (four in the embodiment) air exhaustion units 17 are provided also at the rear side of the cartridge mounting unit 2, with one provided for each cartridge 3. Specifically, each of the four air exhaustion units 17 is positioned upward of each of the four ink extraction units 14. The air exhaustion units 17 allow air to be introduced therethrough into the cartridges 3 when the cartridges 3 are mounted in the cartridge mounting unit 2.

The plurality of connectors 9 (three for each mounting space in the embodiment) are provided in each mounting space of the cartridge mounting unit 2. More specifically, the connectors 9 are provided on an inner surface of the cartridge mounting unit 2 to protrude downward, the inner surface defining an upper end of the mounting space 4*b*. The connectors 9 are formed of a metal that is electrically conductive and has a resiliency. As will be described later, the connectors 9 contact electrodes 20 provided on the circuit substrate 8 of the corresponding cartridge 3 when the cartridge 3 is mounted in the cartridge mounting unit 2.

The cartridge 3 includes a casing 5 for accommodating ink therein, and the circuit substrate 8 for storing various data related to the cartridge 3. The casing 5 has a rectangular parallelepiped shape with a narrow left-right dimension. The casing 5 defines an ink chamber 5*a* therein for storing ink. The casing 5 has a rear wall 5R on whose bottom end portion an ink outlet portion 15 is provided. A valve (not shown) is disposed inside the ink outlet portion 15. The ink outlet portion 15 is connected to the corresponding ink extraction unit 14 when the cartridge 3 is mounted in the cartridge mounting unit 2.

An air communication portion 16 is provided on the rear wall 5R of the casing 5 near the top thereof for allowing air to communicate between the ink chamber 5*a* and the atmosphere. A valve (not shown) is disposed inside the air communication portion 16. The valves provided in the ink outlet portion 15 and the air communication portion 16 remain closed when the cartridge 3 is detached from the cartridge mounting unit 2 ("detached state" as shown in FIG. 3). Thus, when the cartridge 3 is in the detached state, the ink chamber 5*a* is isolated from the exterior of the cartridge 3 in terms of ink flow and air communication.

Figure 4:
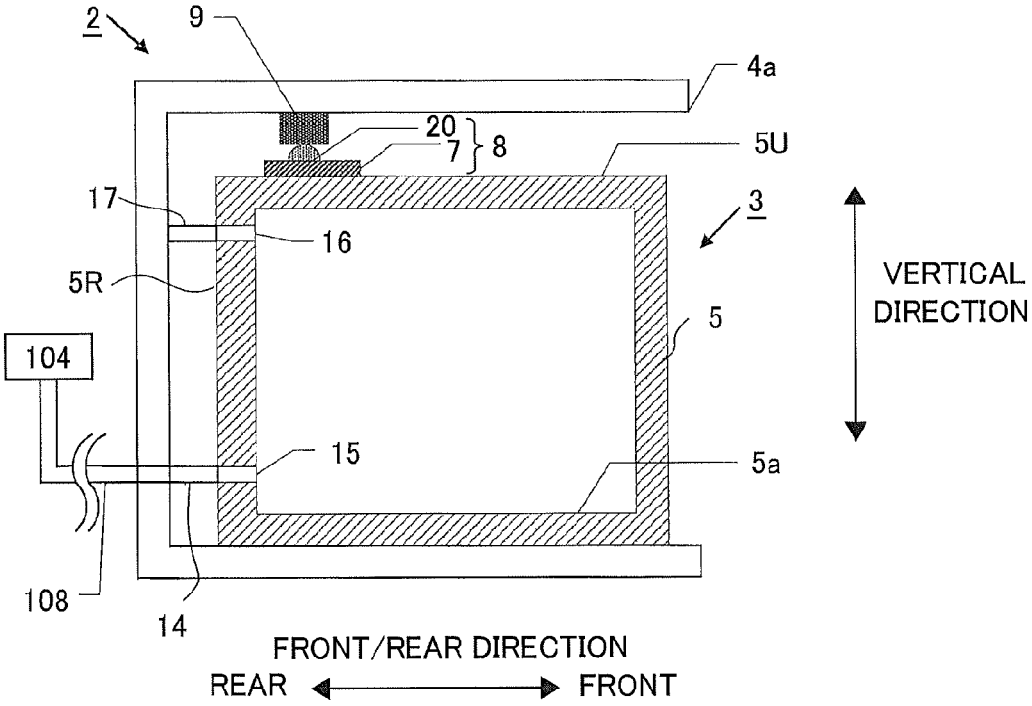
FIG. 4 is a cross-sectional schematic view of the cartridge and the cartridge mounting unit when the cartridge is mounted in the cartridge mounting unit.

When the cartridge 3 is mounted in the cartridge mounting unit 2 ("mounted state" as shown in FIG. 4), the ink outlet portion 15 and the air communication portion 16 are connected to the corresponding ink extraction unit 14 and the air exhaustion unit 17, upon which the valves in the ink outlet portion 15 and the air communication portion 16 are opened.

With the valves opened, air can be introduced into the ink chamber 5*a* the in the cartridge 3, while ink can be supplied into the ink extraction unit 14. That is, in the embodiment, the ink flows out from the ink chamber 5*a* in the rearward direction (in the direction in which the cartridge 3 is mounted).

Figure 5:
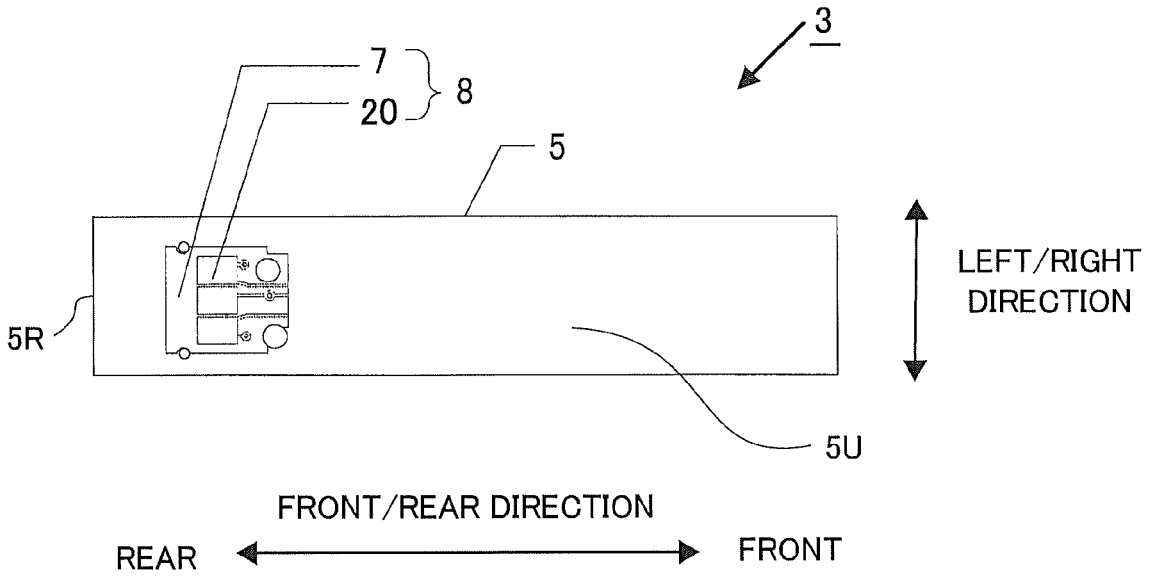
FIG. 5 is a simplified plan view showing an upper surface of the cartridge to which a circuit substrate according to the embodiment is fixed.

The circuit substrate 8 is disposed in a prescribed region on an upper surface 5U of the cartridge 3 (see FIG. 5). The circuit substrate 8 has a top surface on which three electrodes 20 are arranged, and a bottom surface opposite to the top surface and in contact with the upper surface 5U of the cartridge 3. Specifically, the circuit substrate 8 is positioned on the upper surface 5U of the cartridge 3 so that the electrodes 20 on the circuit substrate 8 are aligned with corresponding connectors 9 when the cartridge 3 is mounted in the cartridge mounting unit 2. Thus, in the mounted state, the connectors 9 contact and form electrical connections with the electrodes 20 on the circuit substrate 8. The connectors 9 are urged into contact with the electrodes 20 by their own resiliency at this time.

Next, a detailed construction of the circuit substrate 8 provided on the upper surface 5U of the cartridge 3 will be described with reference to FIGS. 6A and 6B.

Figure 6A:
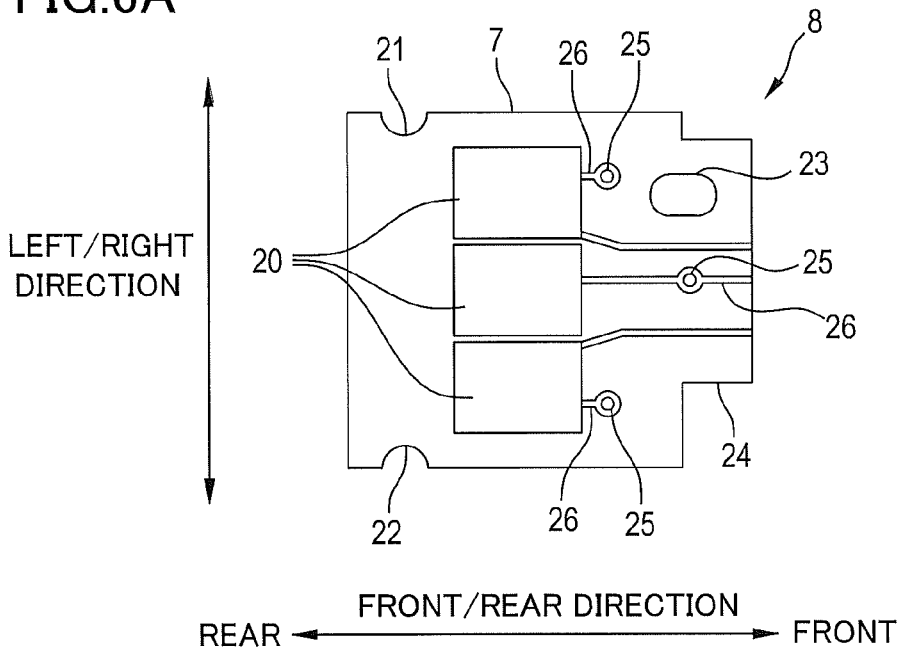
FIG. 6A is a top view of the circuit substrate according to the embodiment.
Figure 6B:
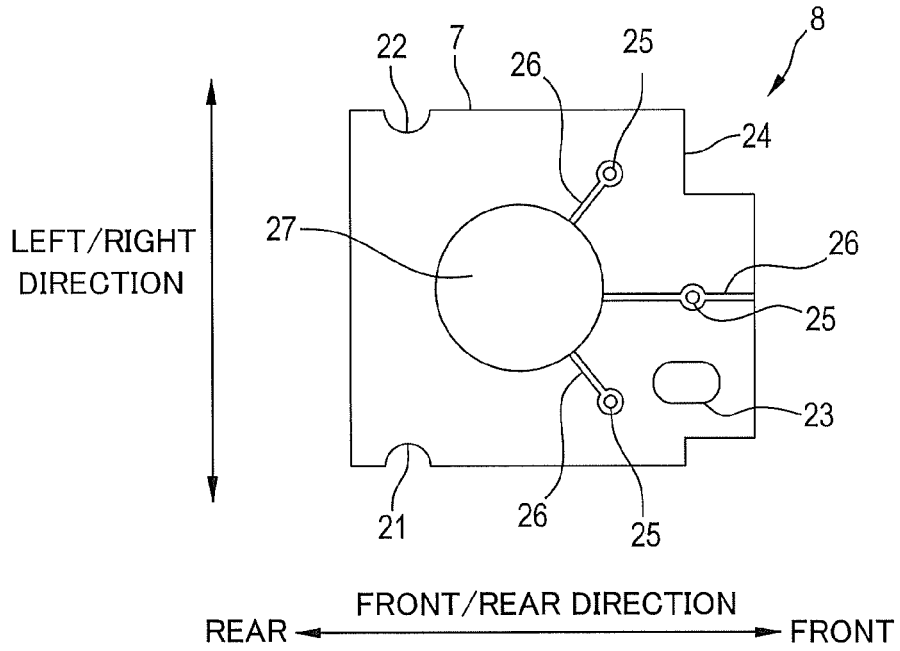
FIG. 6B is a back-side view of the circuit substrate according to the embodiment.

As shown in FIGS. 6A and 6B, the circuit substrate 8 includes: a substantially rectangular substrate body 7 having a shorter left-right dimension than front-rear dimension; three electrodes 20 arranged on the top surface of the substrate body 7; and a storage device 27 provided on the bottom surface. The electrodes 20 are electrically connected to the storage device 27 through wires 26 that pass through through-holes 25 formed in the circuit substrate 8.

The storage device 27 stores information related to the cartridge 3, including its type, serial number, manufactured date, and type of ink it holds. Data related to the type of ink may indicate the color of ink and whether the ink is a pigment ink or a dye-based ink, for example.

The electrodes 20 are formed of an electrically conductive material in a generally rectangular shape. Specifically, the three electrodes 20 are a hot electrode to which power is supplied from the connectors 9, a ground electrode for grounding, and a signal electrode electrically connected to the storage device 27 for outputting signals therefrom via the connectors 9. The three electrodes 20 are juxtaposed in the left-right direction, as shown in FIG. 6A.

Positioning holes 21 and 22 penetrating the substrate body 7 in the vertical direction are formed at positions rearward of the electrodes 20 and closer to left and right edges of the circuit substrate 8 than left and right edges of the electrodes 20. Specifically, one of the positioning holes 21 and 22 is provided in the left edge of the substrate body 7 and the other in the right edge of the substrate body 7.

Figure 7:
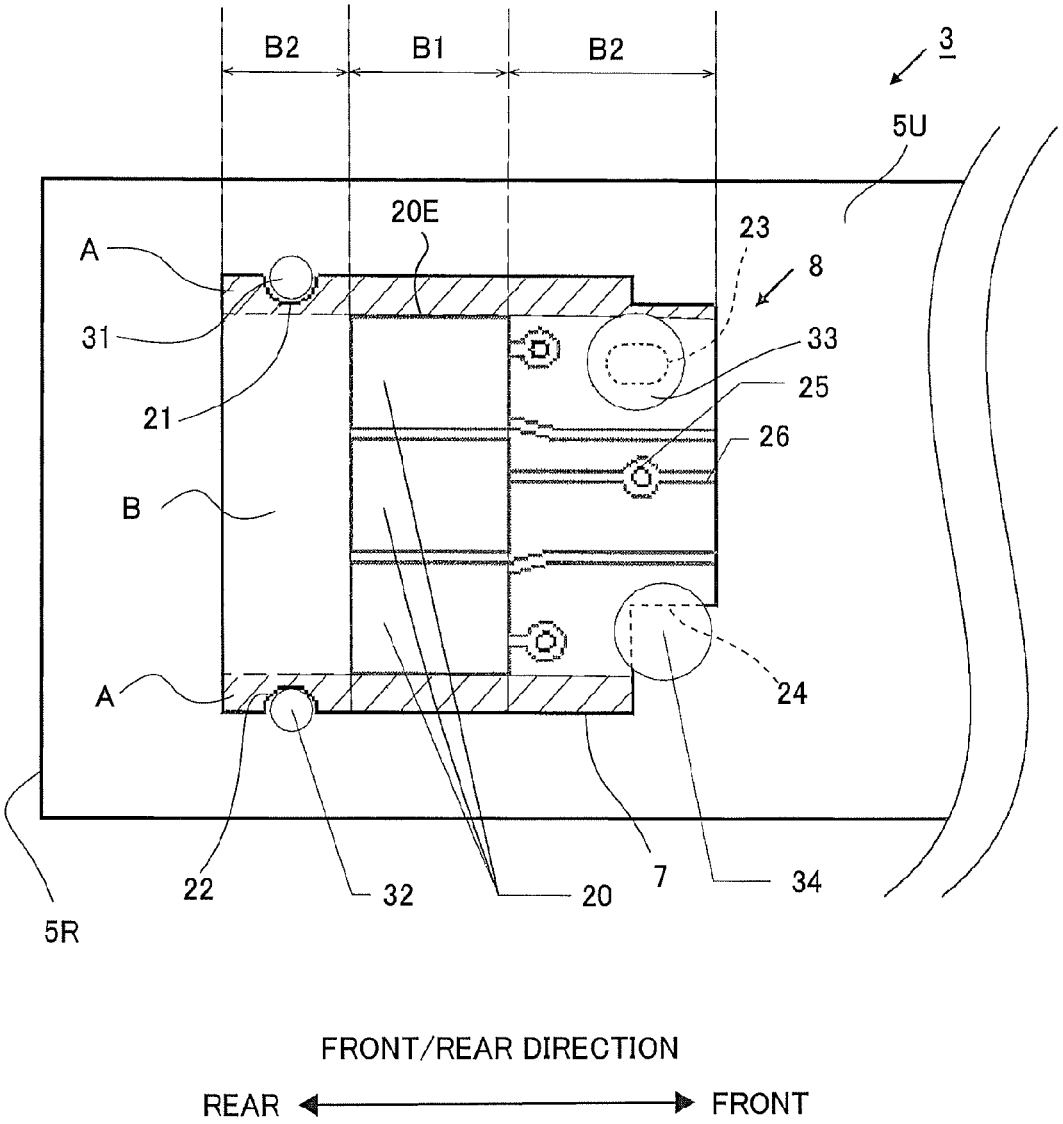
FIG. 7 is a partially enlarged schematic view of the top surface of the cartridge according to the embodiment to which the circuit substrate according to the embodiment is fixed.

More specifically, referring to FIG. 7, it is assumed that the top surface of the substrate body 7 is divided into two hatched regions A (areas between the left and right edges of the circuit substrate 8 and the left and right edges of the electrodes 20 respectively) and a region B interposed between the hatched regions A in the left-right direction. Further, the region B is divided into a region B1 in which the electrodes 20 are mounted, and regions B2 without the electrodes 20. That is, the region B1 and the regions B2 are arranged in the front-rear direction, and the region B1 is aligned with the electrodes 20 in the left-right direction. Preferably, the positioning holes 21 and 22 be formed in the hatched regions A to avoid interference with the connectors 9 during insertion of the cartridge 3. In other words, the positioning holes 21 and 22 are positioned so as not to overlap with the electrodes 20 in the front-rear direction (or in the direction of insertion of the cartridge 3). Further, in the embodiment, the positioning holes 21 and 22 are respectively formed in the region B2 rearward of the electrodes 20 within the hatched regions A.

In the embodiment, the direction of insertion of the cartridge 3 (front-rear direction) corresponds to a claimed first direction, and the left-right direction corresponds to a claimed second direction.

In the embodiment, the positioning holes 21 and 22 are semicircular in shape and open toward the outside.

Further, a distance from the rear edge of the circuit substrate 8 to the positioning hole 21 is equal to a distance from the rear edge of the circuit substrate 8 to the positioning hole 22 in the front-rear direction. That is, the positioning holes 21 and 22 are positioned away from the rear wall 5R of the casing 5 by the same distance as each other in the front-rear direction.

A caulking hole 23 penetrates the substrate body 7 in the vertical direction forward of the electrodes 20. The caulking hole 23 is an elongate through-hole extending in the front-rear direction.

A notch 24 is formed in a corner of the substrate body 7 frontward of the electrodes 20. The notch 24 is a generally rectangular cutout that is open on two sides: specifically, the side parallel to the rear edge of the substrate body 7 and the side orthogonal to the rear edge. The notch 24 makes it possible to identify upper and bottom surfaces of the circuit substrate 8 from an outer contour of the circuit substrate 8. That is, the upper and bottom sides of the circuit substrate 8 can be differentiated by identifying the position of the notch 24 since the position of the notch 24 differs when the circuit substrate 8 is facing up and down.

The notch 24 is formed during manufacturing process of the circuit substrate 8. That is, the notch 24 available in the circuit substrate 8 as manufactured is utilized in the embodiment. A process for forming the notch 24 in the circuit substrate 8 is therefore not necessary.

Next, a detailed construction on the upper surface 5U of the cartridge 3 for mounting the circuit substrate 8 will be described with reference to FIGS. 5 and 7.

A plurality of protrusions is provided on the upper surface 5U of the cartridge 3. Specifically, the protrusions include positioning protrusions 31 and 32, and caulking protrusions 33 and 34 protruding upward from the upper surface 5U. As shown in FIG. 7, the positioning protrusions 31 and 32 are disposed at positions on the cartridge 3 corresponding to the positioning holes 21 and 22 formed in the substrate body 7. The caulking protrusions 33 and 34 are disposed at positions on the cartridge 3 corresponding to the caulking hole 23 and the notch 24 formed in the substrate body 7. The caulking protrusions 33 and 34 have a surface area in a cross section taken parallel to the top surface of the circuit substrate 8 that is smaller than the corresponding area in the caulking hole 23 and notch 24, before the caulking protrusions 33 and 34 are thermally caulked.

Next, how the circuit substrate 8 is mounted on the cartridge 3 will be described.

To mount the circuit substrate 8 on the cartridge 3, the positioning protrusions 31 and 32 of the cartridge 3 are first inserted into the positioning holes 21 and 22 of the circuit substrate 8. In this state, the positioning protrusions 31 and 32 and the positioning holes 21 and 22 contact each other in the front-rear direction, thereby fixing the front-rear position of the circuit substrate 8 relative to the cartridge 3. Additionally, the positioning protrusions 31 and 32 and positioning holes 21 and 22 contact each other also in the left-right direction, thereby fixing the left-right position of the circuit substrate 8 relative to the cartridge 3.

Next, with the positioning protrusions 31 and 32 inserted in the positioning holes 21 and 22, respectively, the caulking protrusion 33 is inserted into the caulking hole 23 and the caulking protrusion 34 is positioned in the notch 24. Inserting these protrusions 33 and 34 into the caulking hole 23 and notch 24 can prevent the circuit substrate 8 from rotating about the positioning protrusions 31 and 32 relative to the cartridge 3.

Since the surface area of a cross section of the caulking protrusions 33 and 34 taken parallel to the top surface of the circuit substrate 8 is smaller than the area of the respective caulking hole 23 and notch 24, the protrusions 33 and 34 on the cartridge 3 can be reliably inserted into the caulking hole 23 and the notch 24 formed in the circuit substrate 8 at this time, even when their positions are not perfectly aligned due to positional deviation in the caulking hole 23 occurred in its formation stage, and positional deviation between the cartridge 3 and circuit substrate 8 when assembling the circuit substrate 8 on the cartridge 3. Further, since the caulking hole 23 is elongated in the front-rear direction, the caulking protrusion 33 can be reliably inserted through the caulking hole 23, even in the event of front-rear positional deviation, thereby preventing the circuit substrate 8 from rotating relative to the cartridge 3.

After inserting the caulking protrusions 33 and 34 into the caulking hole 23 and the notch 24 respectively, the circuit substrate 8 is fixed to the cartridge 3 by thermal caulking in which heat is applied to melt tips of the caulking protrusions 33 and 34. Although the circuit substrate 8 is fixed to the cartridge 3 simply by thermally caulking the caulking protrusions 33 and 34 without thermally caulking the positioning protrusions 31 and 32, the circuit substrate 8 can be more thinly fixed to the cartridge 3 by thermally caulking the positioning protrusions 31 and 32, as well.

As described above, the positioning holes 21 and 22 and the caulking hole 23 are positioned so as not to lie in an insertion path of the cartridge 3 so that the positioning holes 21 and 22 and the caulking hole 23 do not pass over the connectors 9 when the cartridge 3 is mounted in the cartridge mounting unit 2. Accordingly, the protrusions 31, 32 and 33 inserted into the positioning holes 21 and 22 and the caulking hole 23 do not interfere with the connectors 9 during insertion of the cartridge 3. Hence, this construction prevents damage to the connectors 9 caused by contact with protrusions 31, 32 and 33, ensuring good contact between the connectors 9 and the electrodes 20.

Note that, although the positioning holes 21 and 22 are formed in the left and right edges of the substrate body 7 (in the hatched regions A) in the depicted embodiment, it would be possible to avoid contact between the connectors 9 and protrusions 31, 32 when mounting the cartridge 3 even if the positioning holes 21 and 22 were respectively disposed in regions interposed between adjacent electrodes 20. However, such a configuration would require additional space between the neighboring electrodes 20 in the left-right direction to form the positioning holes 21 and 22. To allocate this space, the substrate body 7 would have to be formed with a larger left-right dimension, increasing the left-right dimension of the circuit substrate 8. Since the left-right dimension of the cartridge 3 can be no smaller than the left-right width of the circuit substrate 8, this configuration further limits how compact the cartridge 3 can be made in the left-right dimension.

On the other hand, the circuit substrate 8 according to the embodiment is provided with the positioning holes 21 and 22 formed in the left and right edges of the substrate body 7 (in the hatched regions A in FIG. 7), thereby effectively utilizing the spaces between the left and right edges of the substrate body 7 and the left and right edges of the electrodes 20 without requiring additional space between adjacent electrodes 20. Hence, providing the positioning holes 21 and 22 in the hatched regions A (in the left and right edges of the substrate body 7) as described in the embodiment allows the circuit substrate 8 to be formed in a smaller left-right dimension than when the positioning holes 21 and 22 are arranged between adjacent electrodes 20.

Further, in the depicted embodiment, one each of the positioning holes 21 and 22 is provided in one of the hatched regions A (i.e., one of the left and right edges of the circuit substrate 8) and in the region B2 rearward of the region B1 in which the electrodes 20 are formed. However, the positioning holes 21 and 22 may not necessarily be positioned in the region B2 rearward of the region B1, but may be formed in the region B1 (aligned with the electrodes 20 in the left-right direction) or even positioned in the region B2 frontward of the electrodes 20, provided that the positioning holes 21 and 22 are formed in the regions A. This type of configuration can prevent the protrusions 31 and 32 inserted in the positioning holes 21 and 22 from contacting the connectors 9 when the cartridge 3 is mounted in the cartridge mounting unit 2, thereby preventing damage to the connectors 9 caused by such contact and ensuring reliable contact between the connectors 9 and the electrodes 20. By providing the positioning holes 21 and 22 in the regions B2 that is not aligned with the electrodes 20 in the left-right direction (the region B1), there is no chance that the positioning holes 21, 22 will be formed in the electrodes 20, even if the positions of the positioning holes 21 and 22 deviate left or right during its formation process, thereby preventing damage to the electrodes 20.

Further, in the depicted embodiment, the positioning holes 21 and 22 are respectively shaped as a semicircular hole in the edges of the circuit substrate 8 that is open on the outside. The shape of the positioning holes 21 and 22 is also arbitrary and is not restricted to a semicircular hole that is open on the outside, as in the embodiment. For example, the positioning holes 21 and 22 may be circular, elliptical, polygonal, or the like and need not be open on the outside. Further, the positioning holes 21 and 22 may be open on another edge of the circuit substrate 8 other than its left and right edges.

Further, the circuit substrate 8 may be fixed to the substrate body 7 by thermally caulking the positioning protrusions 31 and 32. This method more reliably fixes the circuit substrate 8. When the positioning protrusions 31 and 32 are thermally caulked, the circuit substrate 8 can be fixed to the cartridge 3 without thermally caulking the caulking protrusions 33 and 34. Hence, the caulking hole 23 and the notch 24 may be omitted and the circuit substrate 8 may be fixed by thermally caulking only the positioning protrusions 31 and 32.

When thermally caulking the positioning protrusions 31 and 32, the caulk heads should be positioned in the hatched regions A on the top surface of the substrate body 7 so as not to be aligned with the electrodes 20 in the front-rear direction. One method of achieving this configuration is to thermally caulk the positioning protrusions 31 and 32 by providing barriers between the positioning protrusions 31 and 32 and the electrodes 20.

When thermally caulking the positioning protrusions 31 and 32, the barriers extending in the front-rear direction should be formed along the boundary between each hatched region A and the region B. The barriers restrict (confine) the positioning protrusions 31 and 32 as they are melted with heat, thereby preventing the molten protrusions 31 and 32 in the hatched regions A from flowing into the region B in which the electrodes 20 are formed. This method ensures that the caulk heads do not contact the connectors 9 when the cartridge 3 is inserted into the cartridge mounting unit 2. Further, in this case, the positioning holes 21 and 22 can even be fowled in the region B1 or in the region B2 frontward of the region B1, since the barriers are formed between the region B and the hatched regions A in which the positioning holes 21 and 22 are disposed.

Further, the number of holes used for positioning may be arbitrary and is not limited to the two positioning holes 21 and 22 as in the embodiment. The circuit substrate 8 can be more reliably fixed to the cartridge 3 by increasing the number of positioning holes. It is also possible to eliminate one or both of the caulking hole 23 and the notch 24. However, the circuit substrate 8 can be securely fixed to the cartridge 3 by providing the caulking hole 23 and the notch 24 and by thermally caulking the protrusions 33 and 34 inserted therethrough. Further, when at least one of the caulking hole 23 and the notch 24 is provided and the protrusion 33 and 34 provided therethrough is thermally caulked, the circuit substrate 8 can be more reliably fixed by providing the positioning holes 21 and 22 farther rearward of the electrodes 20 to increase the distance between the caulking hole 23 and the notch 24 and the positioning holes 21 and 22.

Further, in the embodiment, the boundary between each hatched region A and the region B is defined as a line extending along the front-rear direction, assuming that the left and right edges of the electrodes 20 extend in a direction parallel to the front-rear direction. However, there may be a case where the electrodes 20 do not extend in the front-rear direction. Now it is assumed that one of the electrodes 20 positioned outermost in the left-right direction (either leftmost or rightmost) has an outer edge that is NOT parallel to the front-rear direction. Specifically, referring to FIG. 7, assume that the outermost electrode 20 has an outer edge 20E that extends in a direction intersecting the front-rear direction. In this case, the outer edge 20E should have an outermost point that is positioned outermost in the left-right direction (i.e., the outermost point on the outer edge 20E is positioned closest to the right or left edge of the substrate body 7 in the left-right direction). The boundary between each hatched region A and the region B in this example should be defined as a line extending in the front-rear direction and passing through the outermost point on the outer edge 20E (the outermost point in the outermost electrode 20 in the left-right direction). This configuration can also prevent interference with the connectors 9 during insertion of the cartridge 3.

While the invention has been described in detail with reference to the embodiments thereof, it would be apparent to those skilled in the art that various changes and modifications may be made therein without departing from the spirit of the invention.

What is claimed is:

1. A circuit substrate comprising:

a substrate body having a rectangular shape configured of four sides, the four sides including a first side and a second side extending in a first direction and opposing each other in a second direction, the four sides further including a third side and a fourth side extending in the second direction and opposing each other in the first direction, the substrate body having a top surface; and a plurality of electrodes mounted on the top surface of the substrate body, the plurality of electrodes including a first electrode positioned closest to the first side in the second direction and a second electrode positioned closest to the second side in the second direction among the plurality of electrodes, the first electrode having a first outer point positioned closest to the first side in the second direction and the second electrode having a second outer point positioned closest to the second side in the second direction, the plurality of electrodes defining a third outer point positioned closest to the third side in the first direction, a first imaginary line being defined as a line extending in the first direction and passing through the first outer point, a second imaginary line being defined as a line extending in the first direction and passing through the second outer point, and a third imaginary line being defined as a line extending in the second direction and passing through the third outer point, wherein a first area, a second area, and a third area are defined on the top surface with respect to the second direction, the first area being defined between the first side and the first imaginary line, the second area being defined between the second side and the second imaginary line, the third area being interposed between the first area and the second area in the second direction; and wherein a fourth area is defined on the top surface with respect to the first direction, the fourth area being defined between the third side and the third imaginary line;

wherein the substrate body is formed with a first opening on the top surface such that an entirety of the first opening is positioned within an overlapping area where the first area and the fourth area overlap with each other;

wherein the plurality of electrodes defines a fourth outer point positioned closest to the fourth side in the first direction, and a fourth imaginary line being defined as a line extending in the second direction and passing through the fourth outer point; and wherein the substrate body is further formed with a second opening at a position within an area defined between the fourth side and the fourth imaginary line in the first direction.

2. The circuit substrate according to claim 1, wherein the third area comprises an electrode-mounting region and a non-mounting region aligned in the first direction, the plurality of electrodes being mounted in the electrode-mounting region, and wherein the first opening is aligned with the non-mounting region in the second direction.

3. The circuit substrate according to claim 1, wherein the first opening is positioned adjacent to the first side, and wherein the substrate body is further formed with another first opening in the second area and adjacent to the second side.

4. The circuit substrate according to claim 3, wherein the first opening and the another first opening are positioned to be aligned with each other in the second direction.

5. The circuit substrate according to claim 1, wherein the four sides define an outer periphery of the substrate body, the first opening being open on the outer periphery of the substrate body.

6. The circuit substrate according to claim 5, wherein the first opening is open on the first side of the substrate body.

7. The circuit substrate according to claim 1, wherein the substrate body is further formed with a second opening, and wherein the first opening and the second opening are positioned offset from each other in the first direction.

8. The circuit substrate according to claim 7, wherein the second opening is an elongate through-hole formed on the substrate body.

9. The circuit substrate according to claim 7, wherein the second opening is a notch formed on the substrate body.

10. The circuit substrate according to claim 1, further comprising a storage device configured to store information and being electrically connected to the plurality of electrodes.

11. The circuit substrate according to claim 10, wherein the substrate body has a back surface opposite to the top surface, the storage device being disposed on the back surface of the substrate body.

12. A liquid supplying unit comprising:

a casing defining therein a storage chamber configured to store liquid, the casing having a first casing surface and a second casing surface perpendicular to each other;

a liquid outlet portion provided at the first casing surface and configured to supply the liquid in the storage chamber to outside; and a circuit substrate fixed to the second casing surface and comprising:

a substrate body having a rectangular shape configured of four sides, the four sides including a first side and a second side extending in a first direction and opposing each other in a second direction, the four sides further including a third side and a fourth side extending in the second direction and opposing each other in the first direction, the substrate body having a top surface; and a plurality of electrodes mounted on the top surface of the substrate body, the plurality of electrodes including a first electrode positioned closest to the first side in the second direction and a second electrode positioned closest to the second side in the second direction among the plurality of electrodes, the first electrode having a first outer point positioned closest to the first side in the second direction and the second electrode having a second outer point positioned closest to the second side in the second direction, the plurality of electrodes defining a third outer point positioned closest to the third side in the first direction, a first imaginary line being defined as a line extending in the first direction and passing through the first outer point, a second imaginary line being defined as a line extending in the first direction and passing through the second outer point, and a third imaginary line being defined as a line extending in the second direction and passing through the third outer point, wherein a first area, a second area, and a third area are defined on the top surface with respect to the second direction, the first area being defined between the first side and the first imaginary line, the second area being defined between the second side and the second imaginary line, the third area being interposed between the first area and the second area in the second direction; and wherein a fourth area is defined on the top surface with respect to the first direction, the fourth area being defined between the third side and the third imaginary line;

wherein the substrate body is formed with a first opening on the top surface such that an entirety of the first opening is positioned within an overlapping area where the first area and the fourth area overlap with each other; and wherein the second casing surface is formed with a first protrusion at a position corresponding to the first opening.

13. The liquid supplying unit according to claim 12, wherein the first protrusion is positioned closer to the first side than to the plurality of electrodes in the second direction.

14. The liquid supplying unit according to claim 12, wherein the first opening is positioned adjacent to the first side, the first protrusion being positioned to correspond to the first opening;

wherein the substrate body is further formed with another first opening in the second area and adjacent to the second side; and wherein the second casing surface is further formed with another first protrusion positioned to correspond to the another first opening.

15. The liquid supplying unit according to claim 14, wherein the first opening and the another first opening are positioned to be spaced away from the first casing surface by the same distance with each other in the first direction.

16. The liquid supplying unit according to claim 12, wherein the third area comprises an electrode-mounting region and a non-mounting region aligned in the first direction, the plurality of electrodes being mounted in the electrode-mounting region, and wherein the first opening is aligned with the non-mounting region in the second direction.

17. The liquid supplying unit according to claim 12, wherein the four sides define an outer periphery of the substrate body, the first opening being open on the outer periphery of the substrate body.

18. The liquid supplying unit according to claim 17, wherein the first opening is open on the first side of the substrate body.

19. The liquid supplying unit according to claim 12, wherein the first opening is formed on the substrate body at a position closer to the first casing surface than the electrode to the first casing surface in the first direction.

20. The liquid supplying unit according to claim 12, wherein the substrate body is further formed with a second opening at a position farther away from the first casing surface than the plurality of electrodes from the first casing surface in the first direction.

21. The liquid supplying unit according to claim 20, wherein the second casing surface is further formed with a second protrusion at a position corresponding to the second opening, the circuit substrate being fixed to the second casing surface by thermally caulking the second protrusion through the second opening.

22. The liquid supplying unit according to claim 20, wherein the second opening is an elongate through-hole formed on the substrate body.

23. The liquid supplying unit according to claim 20, wherein the second opening is a notch formed on the substrate body.

24. The liquid supplying unit according to claim 12, wherein the circuit substrate further comprises a storage device configured to store information and being electrically connected to the plurality of electrodes.

25. The liquid supplying unit according to claim 24, wherein the substrate body has a back surface opposite to the top surface and fixed to the second casing surface, the storage device being disposed on the back surface of the substrate body.

26. The circuit substrate according to claim 1, wherein the substrate body is further formed with a pair of further openings positioned to be aligned with each other in the second direction.

27. The liquid supplying unit according to claim 12, wherein the substrate body is further formed with a pair of further openings positioned to be aligned with each other in the second direction.

28. The liquid supplying unit according to claim 12, wherein the first opening is positioned closer to the first casing surface than the plurality of electrodes are to the first casing surface in the first direction; and wherein the substrate body is further formed with a second opening at a position farther away from the first casing surface than the plurality of electrodes are from the first casing surface in the first direction.

* * * * *